United States Patent [19]

Blodee et al.

[11] 4,123,879

[45] Nov. 7, 1978

[54] PANEL WALL SYSTEMS WITH MODULAR COMPONENT BUILD-UP

[75] Inventors: Leif Blodee, Holland; Robert L. Knapp; Simon W. Oppenhuizen, both of Grand Rapids, all of Mich.

[73] Assignee: American Seating Company, Grand Rapids, Mich.

[21] Appl. No.: 810,578

[22] Filed: Jun. 27, 1977

[51] Int. Cl.[2] ..... E04B 2/76

[52] U.S. Cl. ..... 52/36; 52/241; 52/474; 52/511

[58] Field of Search ..... 108/106-109; 52/730, 36, 738, 238, 241, 474, 486, 511; 312/257 SM, 257 SK

[56] References Cited

U.S. PATENT DOCUMENTS

| | | | |
|---|---|---|---|
| 1,735,375 | 11/1929 | Card et al. | 312/257 SK |
| 2,190,004 | 2/1940 | Baker | 52/730 |
| 2,907,471 | 10/1959 | Henry | 108/109 |
| 3,550,338 | 12/1970 | Satkin et al. | 52/474 |
| 3,608,266 | 9/1971 | Satkin et al. | 52/241 |
| 3,733,755 | 5/1973 | Butler | 52/241 |

FOREIGN PATENT DOCUMENTS

| | | | |
|---|---|---|---|
| 492,728 | 3/1919 | France | 52/738 |

*Primary Examiner*—James L. Ridgill, Jr.
*Attorney, Agent, or Firm*—Emrich, Root, O'Keeffe & Lee

[57] ABSTRACT

An improved panel wall system is disclosed with means for interconnecting the panels in any desired angular relationship while providing a sight barrier through the joint. As many of the panels may be connected as are desired; and they may be placed in any desired configuration. Each panel includes an insert assembly to provide its exterior face; and these may be removed and changed, if desired. A full line of shelving and cabinets may be assembled to the panels with a limited number of interchangeable components. The cabinets include a flipper door which will not rack when opened or closed, and which slides beneath the top of the cabinet in the open position, yet has its edges flush with the top and bottom of the cabinet in the closed position.

4 Claims, 73 Drawing Figures

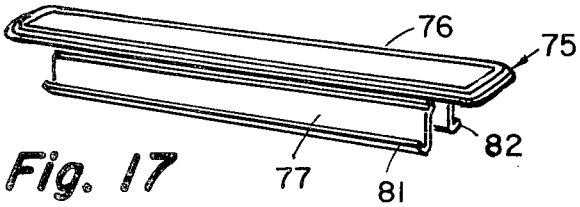
Fig. 17
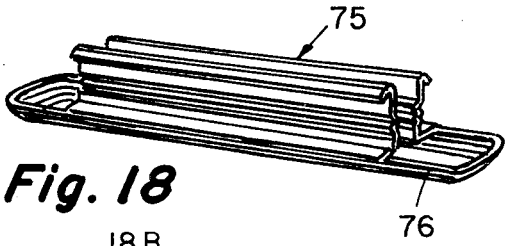
Fig. 18
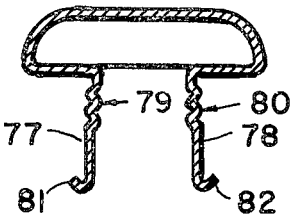
Fig. 19
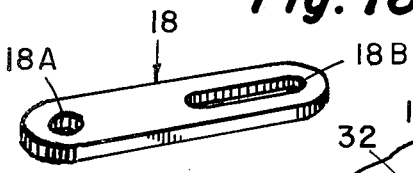
Fig. 20
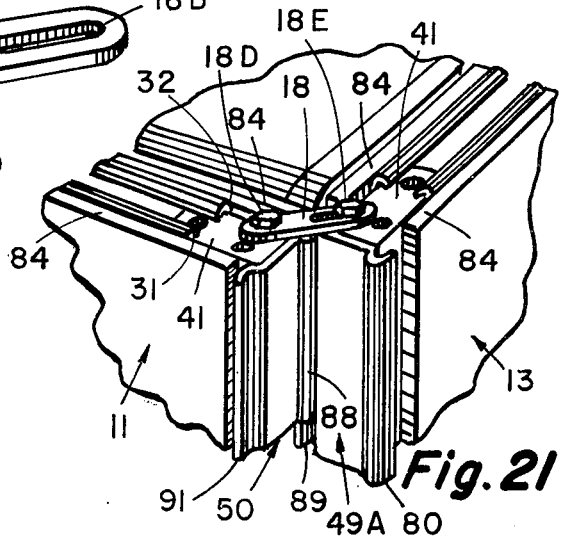
Fig. 21
Fig. 22
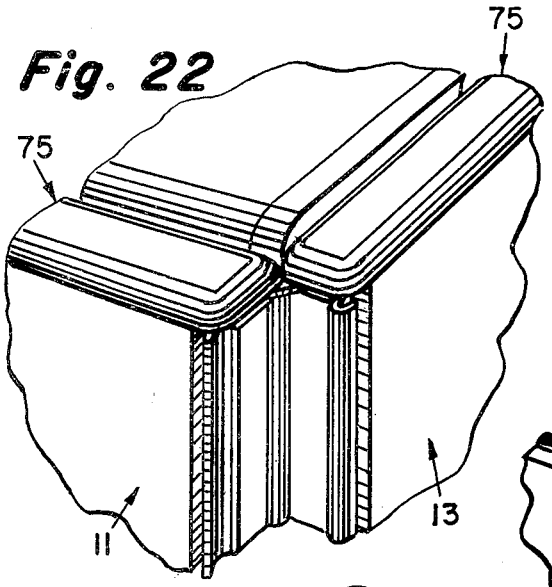
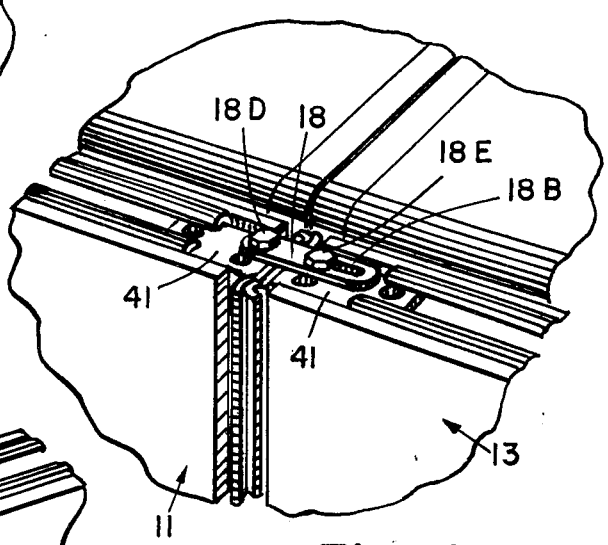
Fig. 24
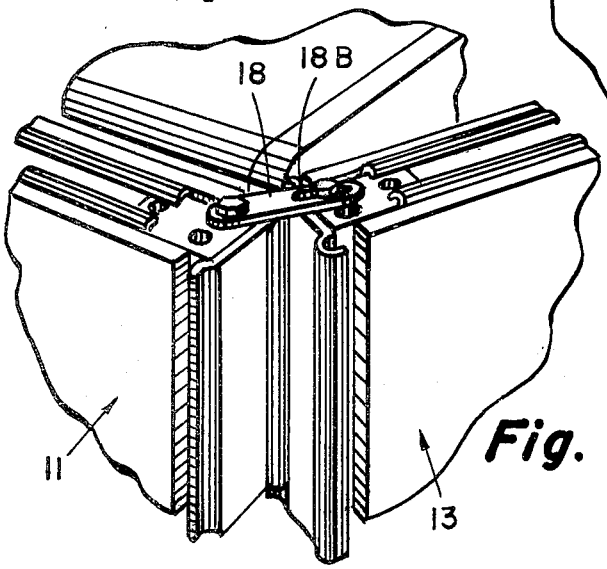
Fig. 23

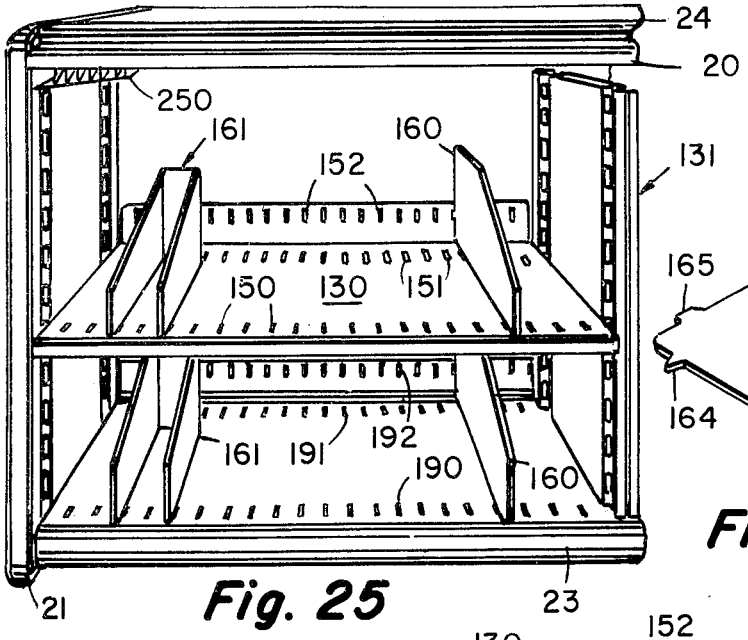
Fig. 25
Fig. 26
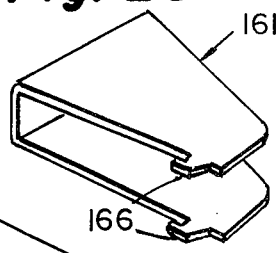
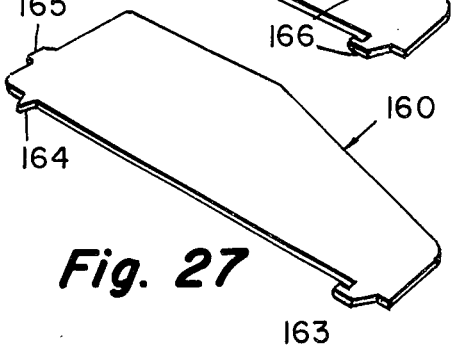
Fig. 27
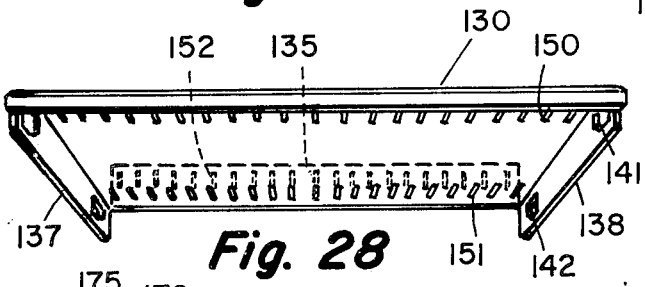
Fig. 28
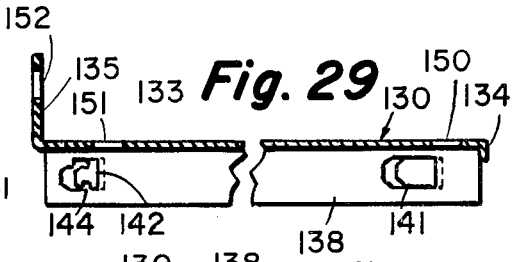
Fig. 29
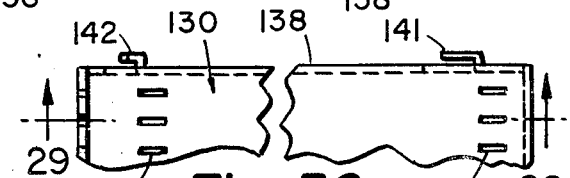
Fig. 30
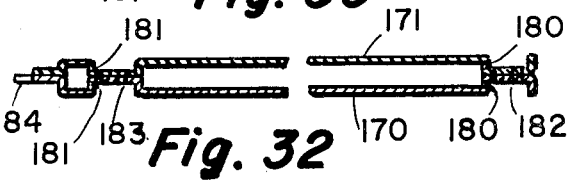
Fig. 32
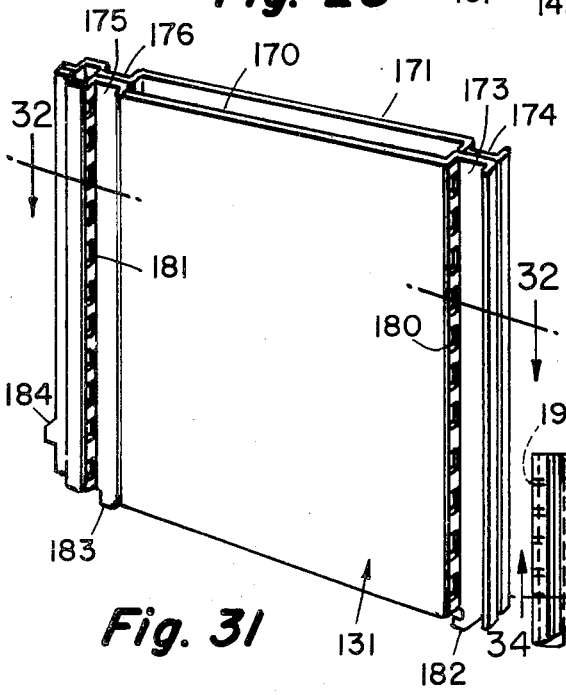
Fig. 31
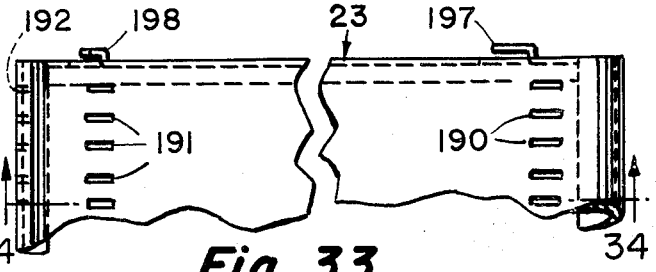
Fig. 33
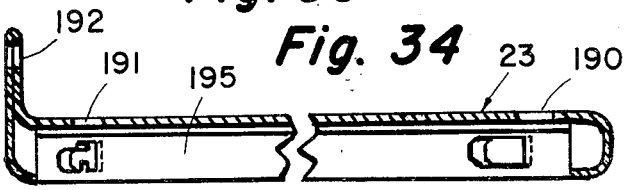
Fig. 34

Fig. 35
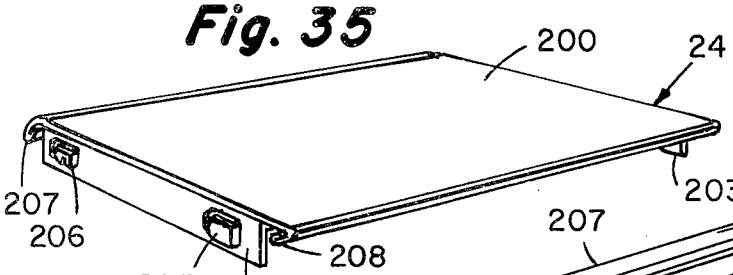
Fig. 36
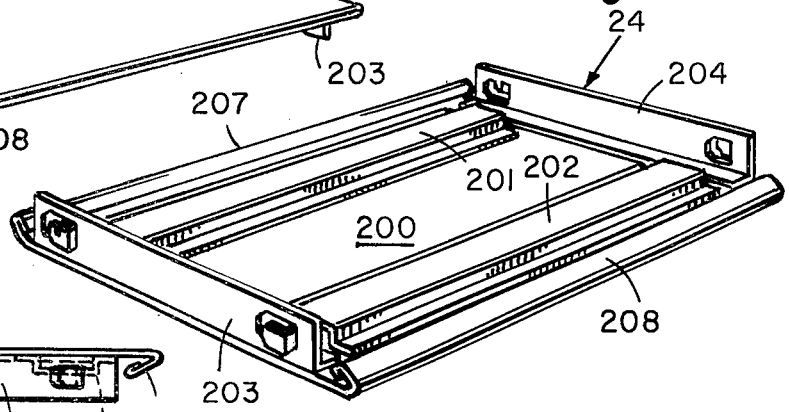
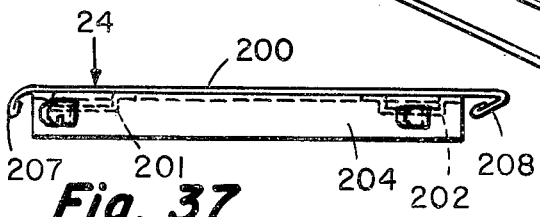
Fig. 37
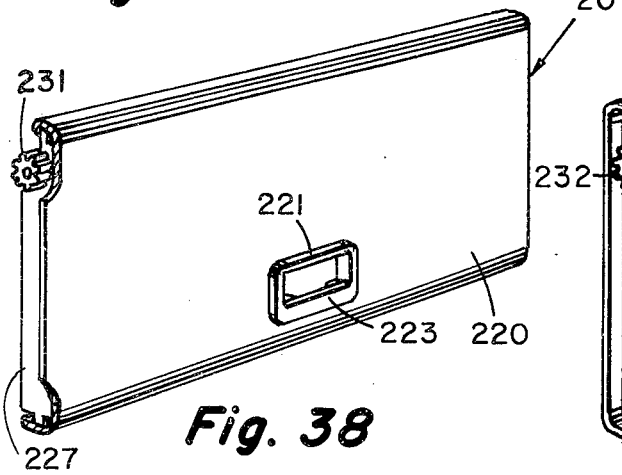
Fig. 38
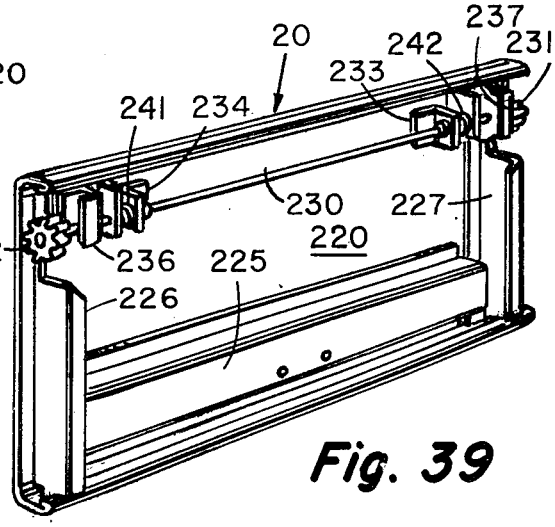
Fig. 39
Fig. 40
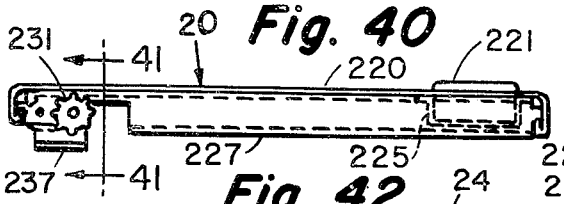
Fig. 41
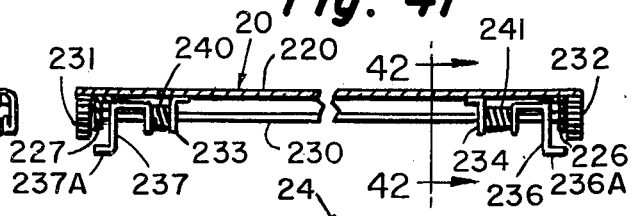
Fig. 42
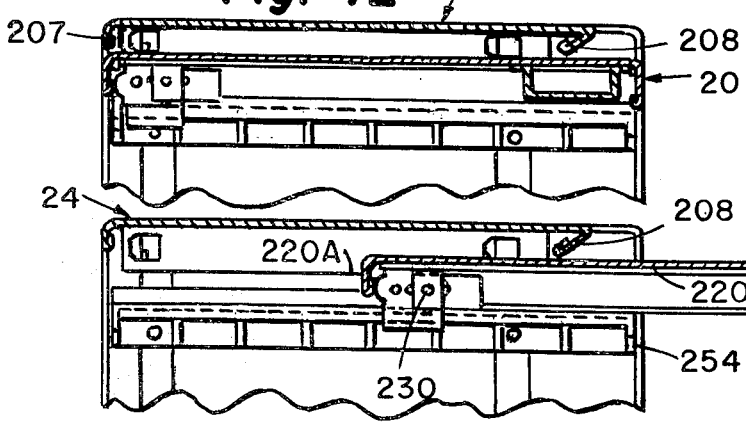
Fig. 43
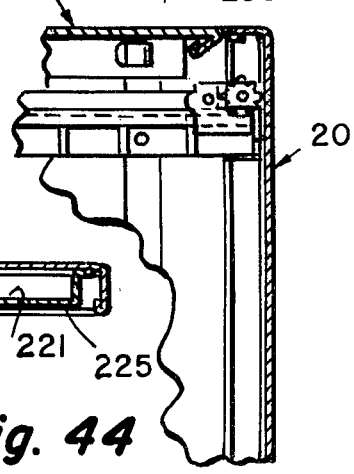
Fig. 44

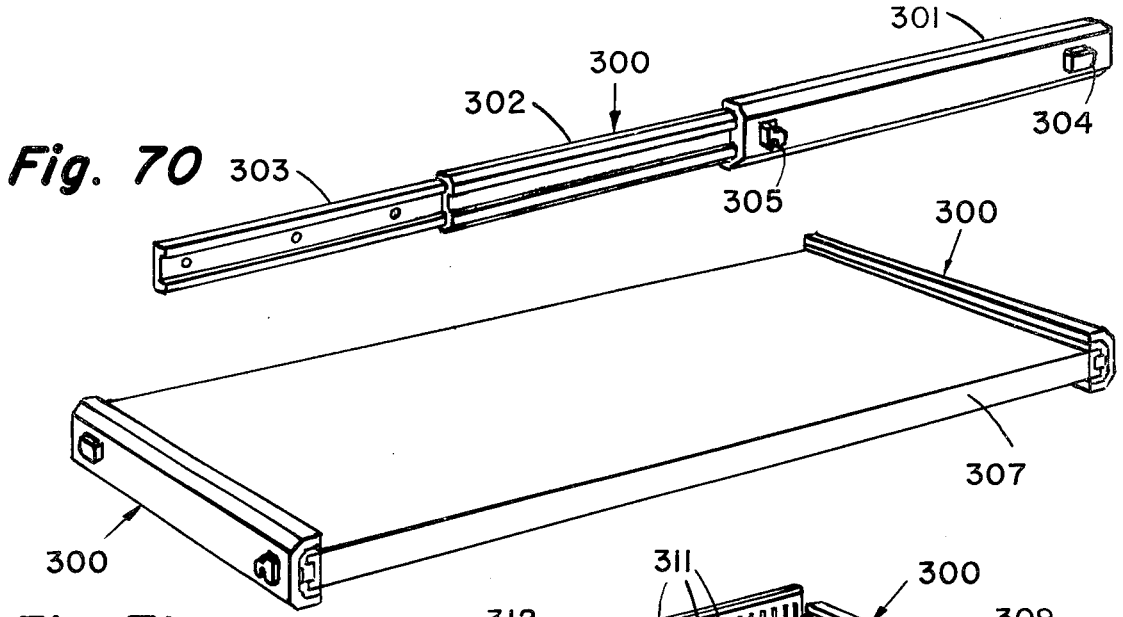
Fig. 70
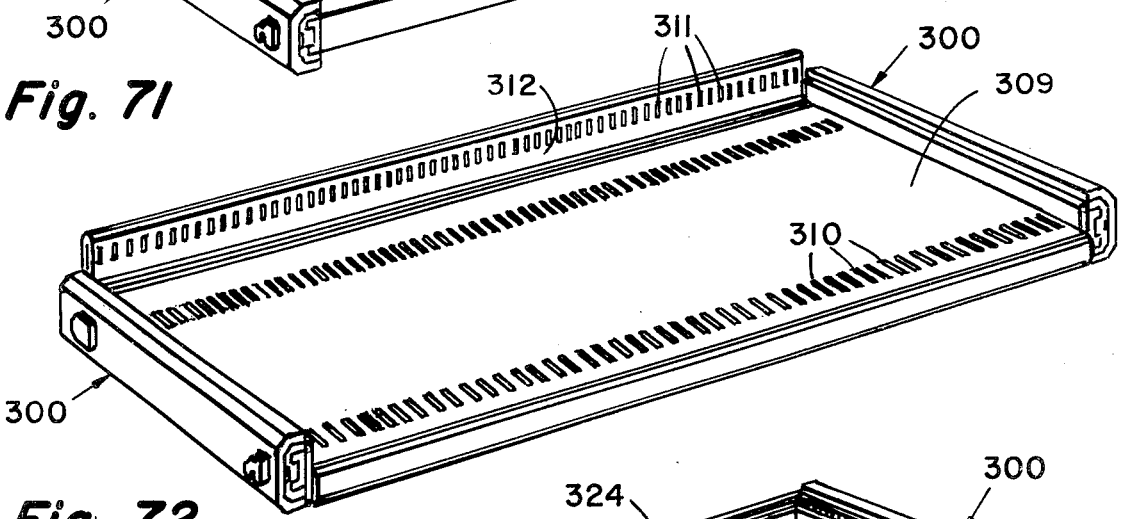
Fig. 71
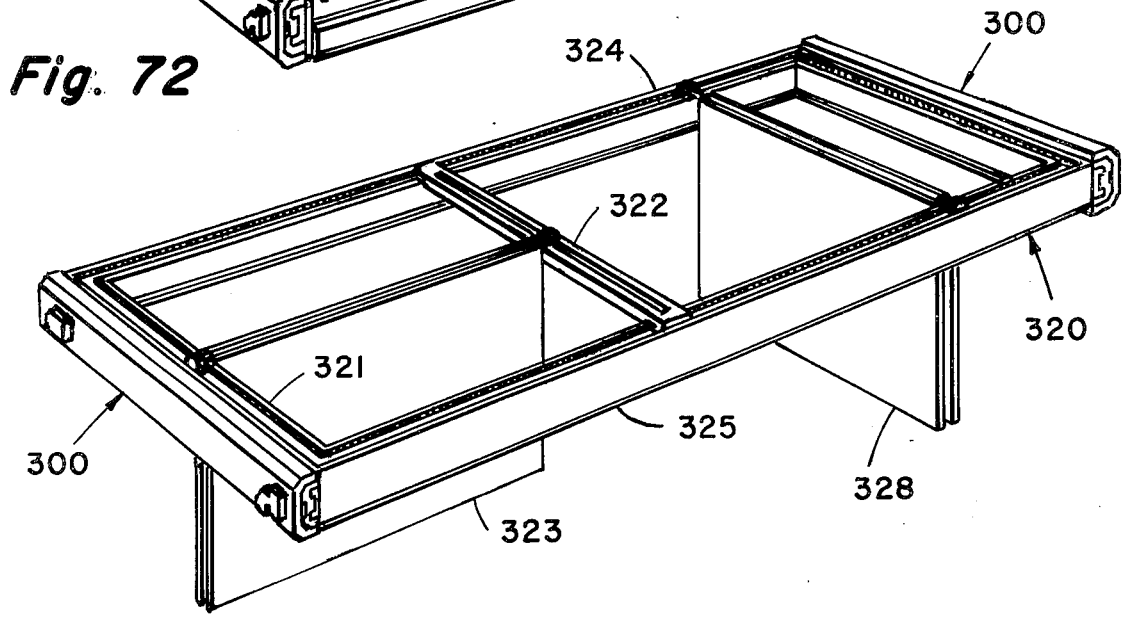
Fig. 72
Fig. 73

PANEL WALL SYSTEMS WITH MODULAR COMPONENT BUILD-UP

BACKGROUND AND SUMMARY

The present invention relates to panel wall systems of the type which are used in offices to provide work stations, storage, filing, counter space and the like. There are systems which are commercially available which are modular in concept in that the panels may be interconnected and that a number of different components may be assembled to and supported by the panels.

The present invention, it is believed, represents significant improvements in systems of this type wherein costs of manufacture, flexibility in use, and aesthetic appearance are important characteristics of the system. One feature of the present invention provides for interchangeability of insert assemblies onto the panel frames. These insert assemblies provide the exterior facing for the panel, and with the present system of interchangeability, many different kinds of insert assembly, such as painted metal, wood veneer, plastic or fabric may be provided with the same frame. These insert assemblies may be removed and changed, if desired, after a period of use.

Another feature of the invention resides in the structure of the frames for the individual panels. Systems are known which use a series of vertically spaced slots for assembling the components to the panels. In the past, some such systems have permitted "light leaks"—that is, the ability for light on one side of the panel to be seen through the panel from the other side. This has occurred both at the locations at which the panels are interconnected and at the locations of the slots just mentioned. One of the objects of the vertically spaced slots is to provide flexibility in the vertical positioning of the components. However, the greater number of slots that are provided in such systems, the greater is the amount of light leaking through to the other side. Not only do such light leaks distract from the appearance of the system, but if the slots or openings are large enough, they actually reduce privacy of an office or work area because persons walking down an aisle, for example, may see directly into the enclosed area. To overcome these objections, the present invention provides a novel panel frame wherein the vertical members of the frame are tubular members with an inwardly projecting flange located between the sets of vertically spaced slots, thereby preventing light leaks through the frame. Further, in order to prevent light leaks between adjacent panels, the edge of each panel is provided with a doubly-curved upright connector. The connectors on adjacent panels cooperate to prevent light leaks between the panel irrespective of the angular orientation of the panels over the useful range at which the panels might be oriented.

Another feature of the present invention is that a full line of shelving and cabinets are included, and they may be assembled to the panel and built up using only a limited number of interchangeable components. Thus, not only is the system modular in the sense that discrete panel assemblies may be interconnected to provide any desired layout, but each panel may be built up to provide storage area, counter area, shelving, desks, if desired, and so on.

In the case of cabinets, a flipper door is used which includes mechanism to prevent rocking of the door when it is opened or closed. The flipper door slides beneath the top of the cabinet in the open position; yet, its edges are flush with the top and bottom of the cabinet in the closed position.

Other features and advantages of the present invention will be apparent to persons skilled in the art from the following detailed description of a preferred embodiment of the system accompanied by the attached drawing wherein identical reference numerals will refer to like parts in the various views.

THE DRAWING

FIG. 17 is a perspective view of a top cap for a completed panel;

FIG. 18 is a perspective view of a top cap of FIG. 17 turned over;

FIG. 19 is a horizontal cross sectional view of the top cap of FIG. 17;

FIG. 20 is a perspective view of a universal connector bracket for two adjacent panels;

FIG. 21 is a fragmentary upper perspective view of the connection between two adjacent panels at right angles to each other without the top caps of the panels;

FIG. 22 is a view similar to FIG. 21 but with the top caps assembled to the respective panels;

FIG. 23 is a view similar to FIG. 24 with the panels slightly more open;

FIG. 24 is a view similar to FIG. 23 but with the panels aligned;

FIG. 25 is an upper perspective view showing the shelving and separators on the left side of the cabinet of FIGS. 3 and 4;

FIG. 26 is a perspective view of an envelope divider lying on its side;

FIG. 27 is a perspective view of a divider partition lying on its side;

FIG. 28 is a lower perspective view of the intermediate shelf of FIG. 25;

FIG. 29 is a vertical cross sectional view with the center broken away, of the shelf of FIG. 28 looking toward the right side thereof;

FIG. 30 is a fragmentary top view, with the center portion broken away, of the right side of the shelf of FIG. 28;

FIG. 31 is an upper frontal perspective view of a vertical support assembly shown in FIG. 25;

FIG. 32 is a horizontal cross sectional view of the vertical support of FIG. 31 with the center portion cut away;

FIG. 33 is a fragmentary plan view, with the center portion cut away, of the right side of the lower shelf of the cabinet of FIG. 4;

FIG. 34 is a vertical cross sectional view taken through the sight line 34—34 of FIG. 33;

FIG. 35 is an upper rear perspective view of the top of the cabinet of FIG. 3;

FIG. 36 is a perspective view of the cabinet top of FIG. 35 turned over;

FIG. 37 is a side view of the cabinet top of FIG. 35;

FIG. 38 is an upper frontal perspective view of a flipper door with a cabinet of FIG. 3 with portions of the upper and lower left edge of the front panel cut away;

FIG. 39 is a rear perspective view of a flipper door of FIG. 38;

FIG. 40 is a side view of the flipper door of FIG. 38 shown in the horizontal position;

FIG. 41 is a cross sectional view, with the center portion cut away, taken through the sight line 41—41 of FIG. 40;

FIG. 42 is a fragmentary vertical cross sectional view taken front to rear of the cabinet of FIG. 3, looking toward the right with the door in the fully open position;

FIG. 43 is a view similar to FIG. 42 with the door partially opened;

FIG. 44 is a fragmentary close-up view of the upper right-hand corner of the cabinet of FIG. 3 with the door in the closed position;

FIG. 70 is a perspective view of a three-piece drawer slide adapted to be incorporated into the present invention;

FIG. 71 is an upper perspective view of a pull-out work surface or shelf which might be incorporated in the present invention;

FIG. 72 is an upper left perspective view of a pullout shelf which might be incorporated into the system, having laterally spaced slots for compartmentalizing; and FIG. 73 is an upper perspective view of a frame, mounted on drawer slides, which might be incorporated into the system for providing pocket file space.

DETAILED DESCRIPTION

Figure 1:
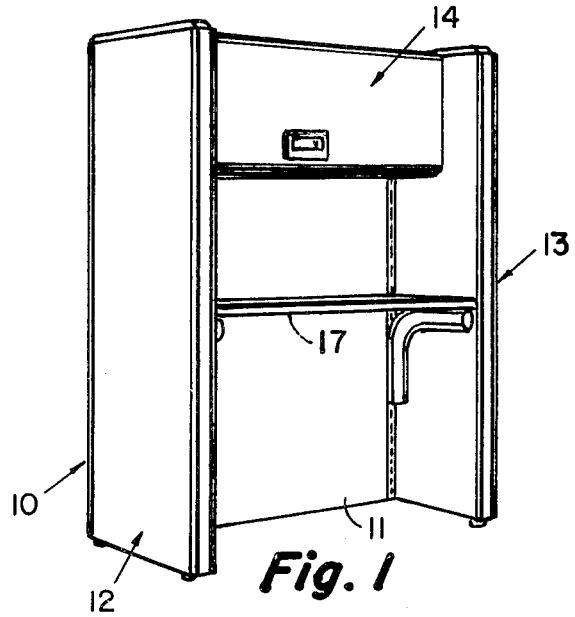
FIG. 1 is a frontal perspective view of a completed work area incorporating the present invention.
Figure 2:
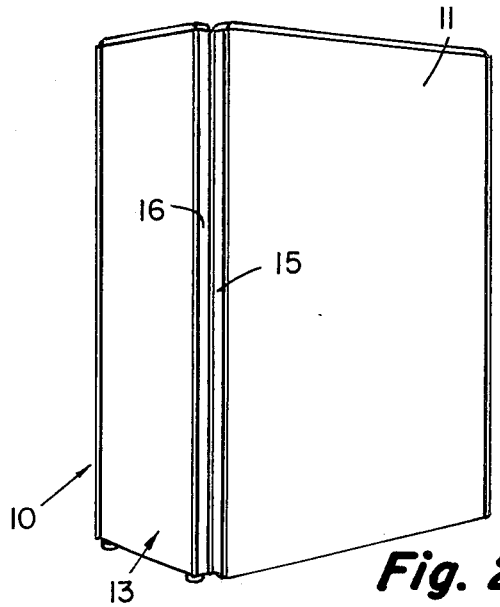
FIG. 2 is a rear perspective view of the system of FIG. 1.

Referring first to FIGS. 1 and 2, reference numeral 10 generally designates a work area in the form of an alcove including a back panel 11, first and second side panels 12, 13, and a cabinet generally designated 14. A cantilevered work surface 17 is supported by the back panel 11 in a manner to be disclosed more fully below. The panels 11, 13 are of similar construction, except that the horizontal extension of the side panel is less than the horizontal extension of the back panel. Thus, the structure of only one panel may be discussed for a complete understanding of the invention.

The panels 11–13 are shown in FIGS. 1 and 2 as completed assemblies, and the word "panel" is used herein to refer to complete panel assemblies. Referring particularly to FIG. 2, the panels 11 and 13 are connected together by means of a bracket which will be disclosed more completely below. However, the adjacent edges of the panels 11, 13 are each provided with a vertically elongated end connector member, designated respectively 15, 16 which cooperate in a manner, also to be disclosed more completely below, so as to prevent the leaking of any light between the panels. A universal connector bracket is shown in FIG. 20 and designated by reference numeral 18, and it connects the tops of the two adjacent panels. A similar bracket connects the bottoms of the same panels.

The bracket 18 includes an aperture 18A and an elongated slot 18B. Referring to FIG. 21, a bolt 18D is received in the slot 18A and threaded into an aperture on a plate 41 of the back panel 11. Similarly, a bolt 18E is received in the slot 18B and threaded into an aperture on a similar plate 41 on the side panel 13. The angular disposition of the two panels is maintained by threading the two bolts tightly onto the connector bracket 18.

When it is desired to maintain a fixed angular relationship between two panels, a fixed connector bracket might be used with two apertures sized to receive the bolts 18D, 18E while maintaining the panels in the desired relation.

If it is desired to open the alcove so that the side panels form oblique angles with the back panel, this is accomplished by loosening the bolts 18D and 18E, changing the panels and tightening the bolts. It will be observed that for all such adjustments, there still is no light leak between adjacent panels; and this is true for a wide range of angular relationships, and it is considered to be an important feature of the invention.

Figure 3:
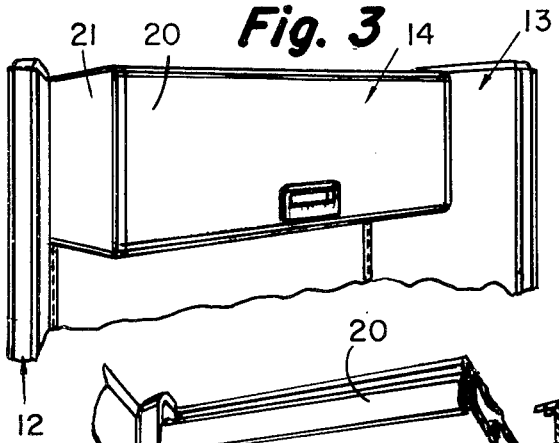
FIG. 3 is a close-up frontal perspective view of the upper portion of the system of FIG. 1 with the side panels slightly more open to show the cabinet.
Figure 4:
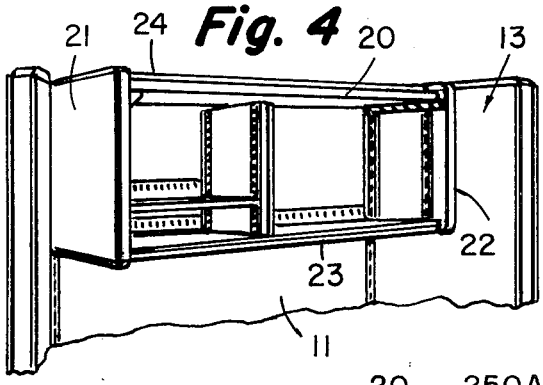
FIG. 4 is a view similar to FIG. 3 with the flipper door of the cabinet opened.

Such an "open" alcove is shown in FIGS. 3 and 4; and in these FIGURES the cabinet 14 can be seen to include a flipper door 20 (seen closed in FIG. 3 and opened in FIG. 4), first and second cabinet side panels 21, 22, a bottom shelf 23, and a top 24. The cabinet end panels 21, 22 are interchangeable—that is, the same structure can be used either as a left cabinet end panel or a right cabinet end panel simply by turning it over, as will be clear from an understanding of subsequent description.

Panel Assembly

Figures 7, 8, 9, 10, 11, 12, 13, 14, 15, 16:
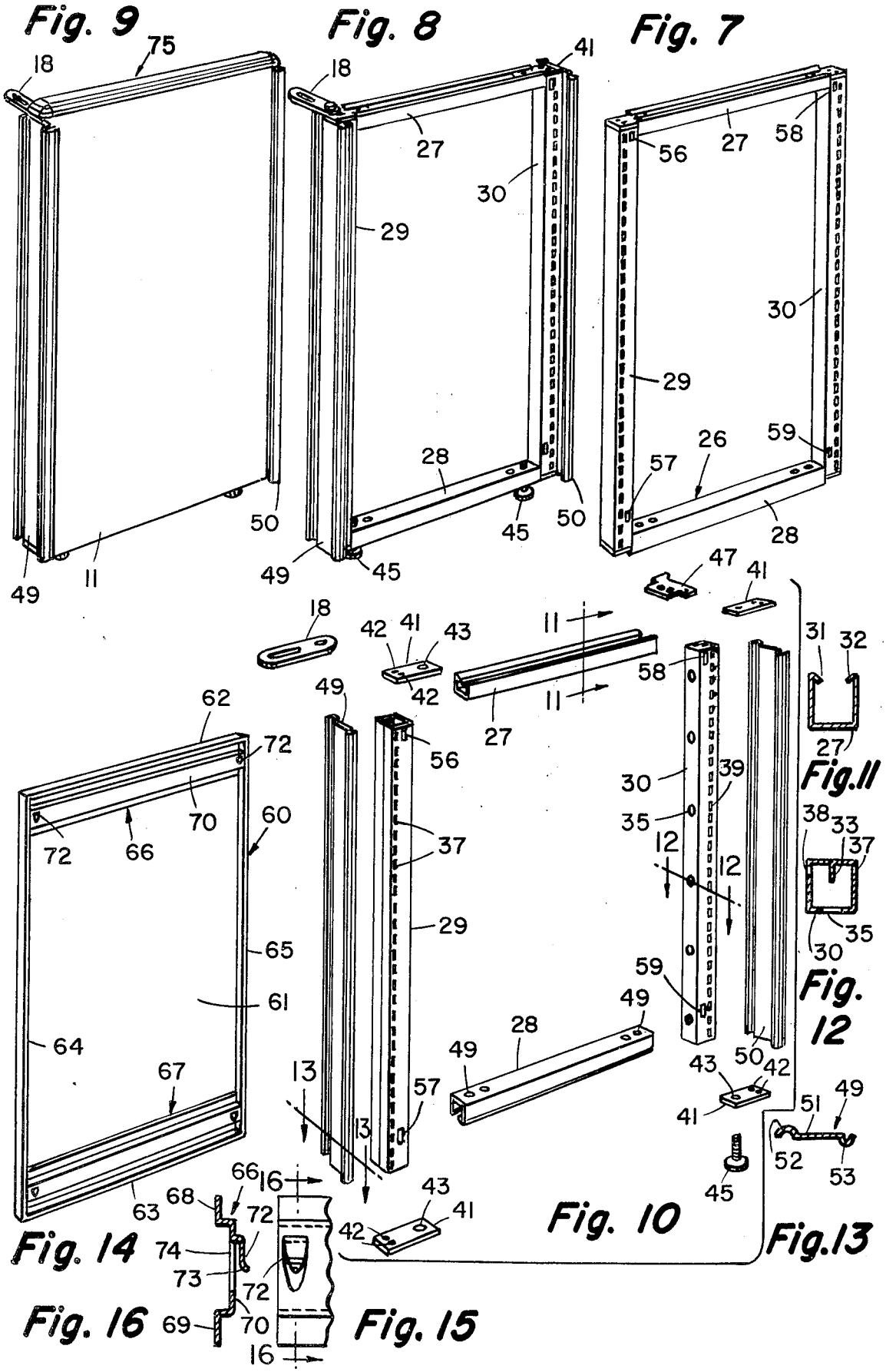
FIGS. 7, 8 and 9 are perspective views of a panel shown in various stages of completion.
FIG. 10 is a perspective exploded view of a completed panel assembly as seen in FIG. 8 without inserts.
FIG. 11 is a cross sectional view of the upper frame channel seen through the sight line 11—11 of FIG. 10.
FIG. 12 is a horizontal cross sectional view of a side tubular frame member seen through the sight line 12—12 of FIG. 10.
FIG. 13 is a horizontal cross sectional view of an end connector as seen through the sight line 13—13 of FIG. 10.
FIG. 14 is a perspective view of the inside of a panel insert.
FIG. 15 is a close-up elevational fragmentary view of a connector tab for the insert of FIG. 14.
FIG. 16 is a cross sectional view of a reinforcement channel for the panel insert of FIG. 14 taken through the sight line 16—16 of FIG. 15.
Figure 45:
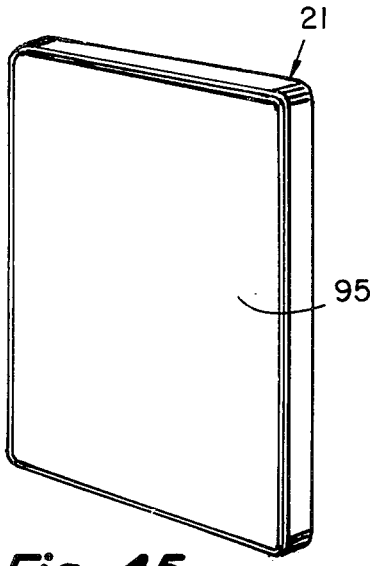
FIG. 45 is a side, frontal perspective view of a cabinet end panel shown as a left side end panel for a cabinet.

Referring now to FIGS. 7–16, the panel assembly 11 (FIG. 9), includes a frame generally designated 26 in FIG. 7. Referring now to FIG. 10, the frame 26 includes an upper channel 27, a lower channel 28, and first and second side tubular members 29, 30.

The upper and lower channels 27, 28 are interchangeable, and they are seen in cross section in FIG. 11 as having a generally U-shape with inwardly turned flanges 31, 32.

Similarly, the side tubular members 29, 30 are interchangeable, and they are seen in cross section in FIG. 12 as including a rectangular tube formed from a single sheet of metal, one of the ends of which is turned inwardly to form a flange 33. The tubular side frame member 30 includes a plurality of vertically spaced round apertures 35 on the inner side, and first and second sets of vertically elongated rectangular slots 37, 38, at a much closer spacing. The slots 37, 38 are seen to be located adjacent the outboard edge of the tubular frame member 30, and the flange 33 is interposed between the sets of slots to form a barrier so that light will not pass through the tube (front to rear) even though the slots 37, 38 (which are referred to as "adjustment" or "hanging" slots) are aligned.

The upper and lower channels 27, 28 are welded to the tubular side frame elements 29, 30 to form the solid frame 26 shown in FIG. 7. The outermost edges (those which contain the inwardly turned flanges 31, 32) of the channel frame members 27, 28 extend beyond the limits of the tubular frame members 29, 30. Each end of each tubular frame member 29, 30 has welded to it a plate 41 which includes a first pair of tapped apertures 42 for securing the connector bracket 18, as described, and a third tapped aperture 43 which is located within the channel frame member adjacent the innermost edges of the inwardly turned flanges 31, 32. Conventional levelers 45 are threadedly received in the apertures 43 for the bottom channel frame member 28, as best seen in FIG. 8, in summary, the plate 41 has two functions. The apertures 42 are used for the attachment of upper and lower connector brackets (or an end spacer member such as the ones shown at 47 in FIG. 10), and the tapped apertures 43 are used at the bottom of the frame to receive the levelers 45. Toward this end, the channels are provided with a pair of apertures 49 through which the levelers may extend (see FIG. 8).

At the top of each frame, when the connector bracket 18 or end spacer 47 are assembled to the plates 41, their upper surfaces are flush with the top of the upper channel member 27 (again, referring to FIG. 8).

First and second end connector elements 49, 50, which are identical to each other, are welded respectively to the outboard edges of the vertical frame support members 29, 30. Referring now to FIG. 13, the end connector 49 includes a central flat web 51, a first curved end portion 52, and a second curved end portion 53. The curvature of the end portions are such that the outer convex surface of the portion 53 conforms to the inner concave surface of the portion 52; and the elements are arranged on adjacent panels in inverted relation so as to achieve mating conformation, as will be described further below.

Referring now to FIGS. 7 and 10, the upright support tubes 29, 30, are each provided with an upper and a lower rectangular slot, designated 56 and 57 for the tube 29 and 58, 59 for the tube 30. These slots are spaced inwardly of the adjustment of "hanging" slots 37, and they are sometimes referred to as the "insert slots" because an insert assembly generally designated 60 and seen in FIG. 14 is hung in these slots. A second pair of similar slots is provided on the other side of each of the upright support tubes 29, 30 for hanging a second, similar insert assembly. Each of the inserts may include different facing material, if desired.

Turning now to FIGS. 14–16, the insert assembly 60 includes a flat panel 61 with inwardly turned upper and lower flanges 62, 63 and side flanges 64, 65 which are doubled over for additional strength. Upper and lower reinforcement channels 66, 67 are provided for hanging the insert assembly to the frame 26 by means of the panel slots, just described.

Referring now to FIG. 16, the reinforcement channel 66 includes first and second welding flanges 68, 69, as well as a raised center web 70. At each end of the web 70, a hook 72 is stamped. Comparing FIGS. 15 an 16, the hook is seen to include an outwardly curved and pointed guide portion 73 to facilitate assembly of the insert assembly to the frame. After all four hooks on the reinforcing members engage the insert slots 56–59 on the frame, the panel is slid down, and the hooks will be seen to include a generally flat spring portion 74 for securing tight engagement with the associated frame. The other panel assembly may be similarly mounted to the frame.

When the inserts are assembled to the frames, the innermost edges of the peripheral flanges 62, 65 of the insert are flush with the tubular frame members 29, 30; so that the hanging slots 37 are recessed in the final panel assembly. The combination of recessing and the light barrier helps to obscure the hanging slots from view, but they are nonetheless readily accessible.

Interconnection of Panels

At the top of each panel, as seen in FIG. 9, there is a top cap generally designated 75, and seen in better detail in FIGS. 17–19. The top cap may be made from plastic or metal, and it includes an upper cover member 76 and first and second legs 77, 78 which are corrugated as at 79, 80 respectively. The lower end of each of the legs further is curved upwardly and outwardly at 81, 82 respectively so as to form catches for the flanges 31, 32 on the upper channel members.

Referring now to FIGS. 17 and 18, the length of the cover 76 extends from one end connector 49 to the other end connector 50 when the top cap is assembled to a panel. However, the length of the legs 77, 78 are shorter by a distance which will permit the top cap to be raised and moved to one side (see FIG. 22) in order to uncover the connecting bracket 18, if desired. This facilitates rearranging the wall panels when desired, without removing the top caps. When the top caps are raised, the catches 81, 82 engage the downwardly turned edges 31, 32 of the upper channel member 27 of the frame (see FIGS. 7 and 11). This also permits the inserts to be raised and removed if desired for replacement or changing.

In order to assemble two panels together, the bracket 18 (and a corresponding one at the bottom) is secured to the respective panels by means of bolts 18D and 18E which are threaded into the apertures 42 on the plates 41 in the respective panels 11, 13.

It will also be seen from FIG. 21 that for this orientation of the panels, the two end connector strips 50 (for panel 11) and 49A (for panel 13) cooperate to prevent light transmission through the connection. Specifically, in this orientation, the smaller rounded edge 88 of the connector 50 is received in the larger rounded portion 89 of the end connector 49A. If the panel 13 were turned 180°, the same connector brackets could be used, but the smaller rounded edge 90 of the connector 49A would then be received in and turned within a larger rounded edge 91 of the connector 50.

After the two panels are thus secured together, the end caps 75 are put in place as seen in FIG. 22. If it is desired to have further access to the connection, the end caps may be raised so that the latches on the end caps engage the inwardly and downwardly turned edges of the associated top channel; and the end caps may then be slid to the side. If it is desired to completely remove the end cap 75, they are lifted upwardly, and the legs 77, 78 are pushed inwardly until the catches 81, 82 clear the curved edges of the upper channel 27 of the panel frame.

If it is desired to change the inclination of the panels, the top caps 75 are lifted and slid to the side to the access position, and the threaded studs 18D and 18E are loosened from the plates 41. The panels may then be adjusted with the stud 18E sliding in the slot 18B until the desired position is achieved, such as a 120° angle (FIG. 23) or a 180° angle (FIG. 24). The bolts are then re-tightened at top and bottom. After the brackets are secured, the top caps 75 are repositioned on their associated panels.

As already indicated, by raising the top cap to its upper position, while still in engagement with the upper channel of the frame, it is possible to lift and remove the panel insert without completely removing the top cap from the panel. This is desirable, for example, for replacing an insert assembly or for changing it to a different color or material or replacing it.

Shelf Components

Referring now to FIG. 25, the cabinet side panel 21, flipper door 20, cabinet top 24 and cabinet bottom shelf 23 have already been identified.

Figure 46:
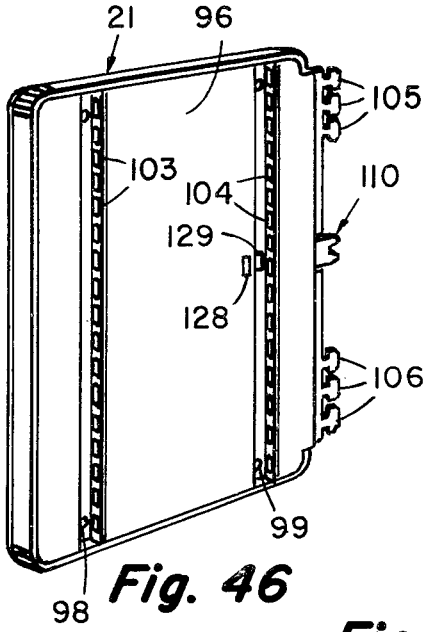
FIG. 46 is a right frontal perspective view of the cabinet side panel of FIG. 45.
Figure 47:
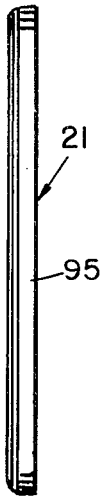
FIGS. 47 and 48 are front and rear elevational views of the panel of FIG. 45.
Figure 48:
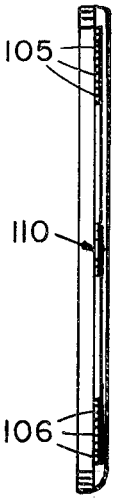

The cabinet side panel 21 is shown individually in FIGS. 45–48. The cabinet side panel includes an outer flanged facing 95, and an inner metal sheet 96 (FIG. 46). The inner element 96 includes a pair of spaced parallel grooves 98, 99, which extend vertically. As illustrated, the grooves are preferably located so that one is located toward the front of the panel and the other is located toward the rear of the panel. Both grooves have rear vertical surfaces which have adjustment slots designated respectively 103 (for the groove 98) and 104 (for the rear groove 99). These slots permit the mounting and adjustment of shelves on one-inch increments.

At the rear of the cabinet side panel 21, there are three upper tabs 105 and three lower tabs 106. The tabs 105, 106 are spaced according to the spacing of the recessed hanging slots 37 in the vertical tubular supports 29, 30 of the panel frame (FIGS. 7 and 10). Further, the tabs 105, 106 each have symmetry and define upwardly and downwardly projecting fingers for engaging the hanging slots on the panel frame. Thus, the cabinet side panel 21 may be used either as a left panel side or a right panel side by turning it over.

Between the tabs 105, 106 there is a spring-biased locking member 110 projecting from the rear of the panel 21 and in vertical alignment with the slots 105, 106.

Figure 49:
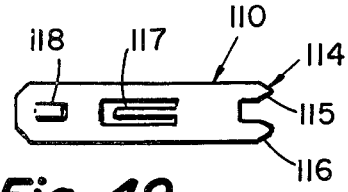
FIGS. 49 and 50 are side views of the locking tongue of the cabinet side panel of FIG. 45 shown without and with a center spring respectively.
Figure 50:
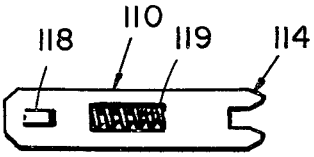
Figure 51:
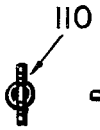
FIG. 51 is a right end view of the tongue of FIG. 50.
Figure 52:
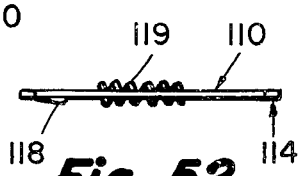
FIG. 52 is a top view of the tongue of FIG. 50.
Figure 54:
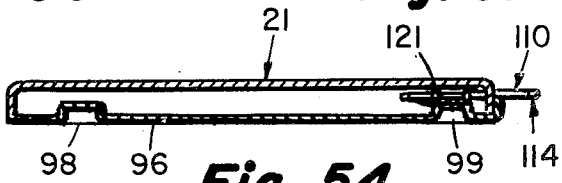
FIG. 54 is a complete horizontal cross sectional view of the cabinet side panel of FIG. 45.
Figure 59:
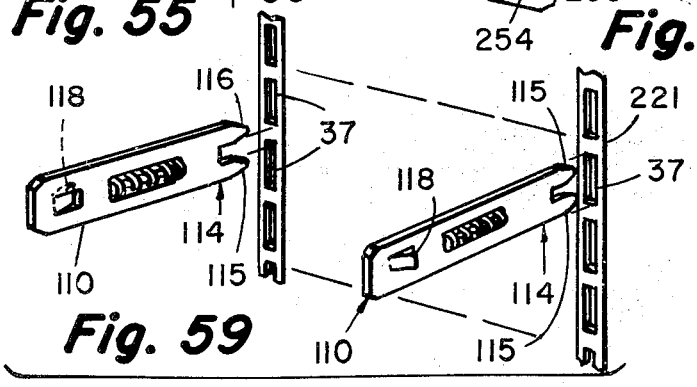
FIG. 59 is a perspective diagrammatic view illustrating the coupling of the tongues of the cabinet side panels to the recessed hanging slots.

Referring now to FIGS. 49, 54 and 59 the locking (or "latch") member 110 includes a bifurcated tongue generally designated 114 having first and second projections 115, 116. These projections are spaced so as to straddle the material separating two of the hanging slots 37 on the left side of the panel frame. Conversely, when the cabinet side panel is used on the right side, the projections 115, 116 fit within the same slot 37, but in both cases, the coupling prevents vertical movement of the side panel once the locking member is in place. At the center of the latch member 110 there is a protruding straight portion 117, and at the end there is an outwardly projecting stamped offset 118. A spring 119 is received on the straight portion 117 (see FIGS. 50–52).

Figure 53:
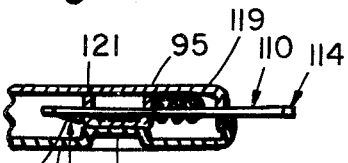
FIG. 53 is a close-up fragmentary horizontal cross sectional view of the rear end of the panel of FIG. 45 showing the assembled structure of the locking tongue.

Referring now to FIGS. 53 and 54, the latch member 110 is received in a U-shaped bracket 121 mounted within the cabinet end panel on the flat portion of the rear groove 99. The spring 119 is in compression and bears against the adjacent side of the bracket 121, thereby urging the latch member outwardly. Its outward motion is inhibited by the offset 118 which interferes with the other side of the bracket 121, as seen in FIG. 53. Referring back to FIG. 46, an aperture 128 is formed in the inner side material 96 of the panel, and if an object such as a key is inserted in this slot, as illustrated by the arrow 113 in FIG. 53, the projection offset 118 will be returned to its original position and the latch member may be removed from the bracket 121. As best seen in FIG. 46, a slot 129 is formed in the base of the groove 99, and this permits a key or screwdriver to be inserted and engage the central slot on the latch member 110 to pull it rearwardly and thereby disengage the latch to remove the cabinet side panel, if desired.

In order to install the side panel in the hanging slots on the panel frame, the latch member 110 is retracted as just disclosed, further compressing the spring 119. The set of tabs 105, 106 are then aligned with the hanging slots in the panel frame 26, and the cabinet side panel 21 is moved downwardly so that the lower fingers of the tabs engage the slots. Next, the latch member 110 is permitted to extend outwardly and the bifurcated tongue 114 engages the material between adjacent slots or to fit into a slot, depending on whether it is used as a left or right side panel, as illustrated in FIG. 59. Thus, the panel is "locked" into the panel frame and cannot be inadvertently removed, nor can it be raised without retracting the locking member 110 through the slot 129.

Referring now to FIG. 25, an intermediate shelf 130 is supported between the cabinet side panel 21 and a vertical support assembly generally designated 131. The intermediate shelf 130 is shown in FIGS. 28–30 as including a flat portion 133 which provides the shelf space, a downwardly turned forward edge 134, and an upwardly turned rear edge 135. At each end of the shelf there is an end mounting bracket and these are designated 137 and 138 in FIG. 28. Each bracket is similar, and referring to the bracket 138 in FIGS. 29 and 30, a forward tab projection 141 and a rear tab projection 142 are stamped from the bracket. It will be observed that the rear tab on the other bracket, for securing the shelf in place. The left side tabs, of course, fit into the cabinet side panel 21, and the right side tabs fit into a similar structure on the vertical support assembly 131, to be discussed presently.

The shelf includes three sets of slots designated respectively 150, 151 and 152 and located respectively along the forward edge of the flat shelf portion 133, the rear edge thereof, and on the upwardly turned rear flange 135. The slots of each set are aligned forward to rear, and they are used to secure separators such as the file separator 160 in FIG. 27 or the envelope pouch 161 of FIG. 26. The file separator 160 includes a forward locking tab 163, a lower rear projection 164 and an upper rear tab 165 for fitting respectively into one of the slots 151 and 152. The envelope holder 161 includes only forward locking tabs 166 which fit into the forward slots 150.

Turning now to the bottom shelf 23 as seen in FIGS. 33 and 34, it also includes three sets of slots designated respectively 190, 191 and 192 similar to the corresponding sets of slots for the intermediate shelf. The bottom shelf also includes side mounting brackets, one of which is shown at 195, which includes forward and rear mounting tabs 197, 198 for mounting the shelf to the cabinet side panels 21, 22 (FIG. 4).

Turning now to FIGS. 31 and 32, the vertical separator assembly can be seen to include first and second pieces of sheet metal 170, 171 which form a pair of forward grooves 173, 174 similar to the vertical grooves 98, 99 shown in FIG. 46 of the cabinet side panel 41. A pair of rear adjustment grooves 175, 176 are formed in the vertical separator assembly. Each of the grooves is provided with adjustment slots designated 180 and 181 for the respective grooves. Similarly, the assembly is provided with a forward locking tab 182 for fitting into one of the slots 190, a lower rear projection 183 for being received in one of the slots 191, and an upper rear tab 184 for fitting into one of the slots 192 in the lower shelf 23 (see FIG. 33). The tabs 182, 183 and 184 are formed in only one of the sheet metal pieces 170, 171, as seen in FIG. 32.

Turning now to FIGS. 35 and 36, the cabinet top panel 24 includes a covering sheet 200 which is provided on its underside with first and second channel reinforcment elements 201, 202 in FIG. 36, and first and second side mounting brackets 203, 204. These brackets include forward and rear mounting tabs 205, 206 similar to the ones discussed in connection with the shelves, and they permit the cabinet top to be mounted into the cabinet side panels 21, 22. It will be observed that the rear edge of the top is curved at 207, whereas the forward edge 208 is more sharply bent to cooperate with the flipper door, to be described presently. In both cases, the edges are bent back on themselves to avoid sharp edges.

Flipper Door Assembly

Figure 60:
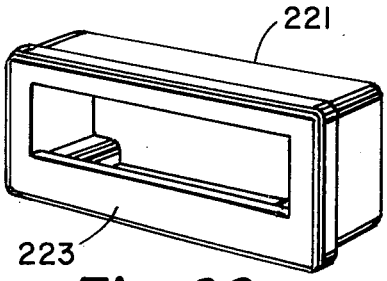
FIGS. 60, 61 are frontal left and rear right side perspective views respectively of a handle for the flipper door of FIG. 38.
Figure 61:
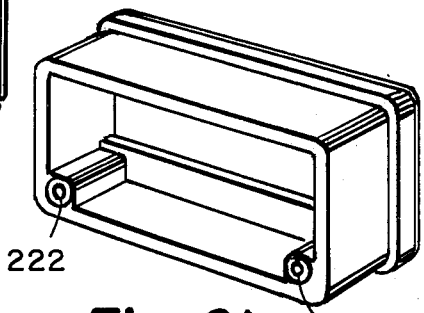

Referring now to FIGS. 38–41, the flipper door 20 includes a covering sheet 220 which is fitted with a recessed handle 221, seen better in FIGS. 60 and 61. The handle is mounted from the rear by inserting screws in the two mounting blocks designated 222 in FIG. 61. A finger grip is shown at 223.

Returning now to FIGS. 38, 39, a reinforcing channel 225 is provided at the bottom of the flipper door 20 on the rear side of the facing sheet 220. First and second side channels 226, 227 are mounted on their stiffeners to the rear of the door, and they extend transversely of the channel 225. The the top of the door there is a transverse rod 230, at the ends of which are mounted nylon pinions 231, 232. The rod is rotatably mounted to the back of the flipper door by means of brackets 233, 234. Also mounted on the rods between the brackets and the pinions is a pair of sliding clips 236, 237 which take the form, as seen in FIG. 41 as an inverted U-shaped channel with outwardly projecting lower flanges 236A and 237A respectively. Interposed between the brackets and the clips are first and second coil springs 240, 241 for urging the clips outwardly relative to the fixed brackets.

Figure 55:
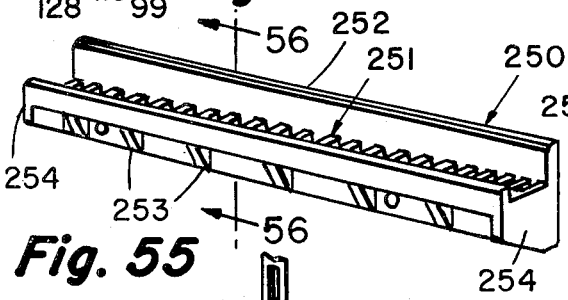
FIG. 55 is a frontal perspective view of a right side slipper door rack for the cabinet of FIG. 3.
Figure 56:
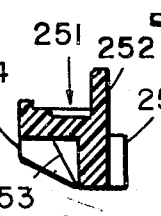
FIG. 56 is a cross sectional view taken through the sight line 56—56 of FIG. 55.
Figure 57:
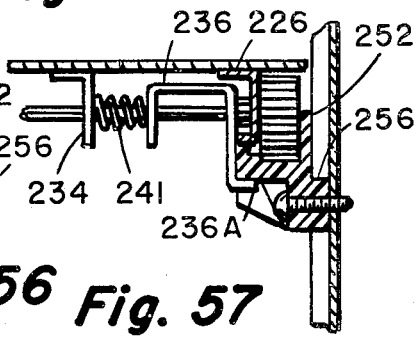
FIG. 57 is a close-up fragmentary horizontal cross sectional view similar to FIG. 56 showing the slipper door rack assembled to the cabinet of FIG. 3.
Figure 58:
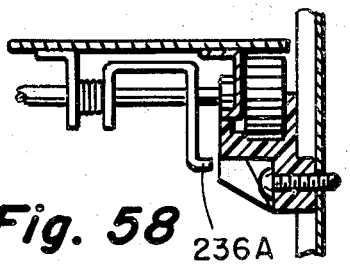
FIG. 58 is a view similar to FIG. 57 illustrating the unlatching of the flipper door from the cabinet.
Figure 62:
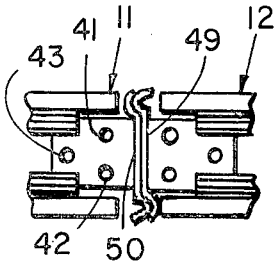
FIGS. 62–65 are plan views of the adjacent portions of two panels arranged in different angular orientations.

The flipper door is mounted to a pair of tracks, one of which is shown in FIG. 55 and designated 250. The tracks are shown, in their mounted position in FIGS. 5 and 6, and they are designated 250 and 250A respectively. Turning now to FIG. 55, the track 250 includes a rack 251 which is integrally formed with an upright wall 252, and supported by a pair of intermediate braces 253, and first and second larger end braces 254 (see FIG. 56). On the back of the upright wall 252, there is a pair of spacers, one of which is shown at 256 for fitting into the grooves 98, 99 of the cabinet side panel. The tracks are mounted by screws, as seen in FIGS. 57 and 58.

Figure 5:
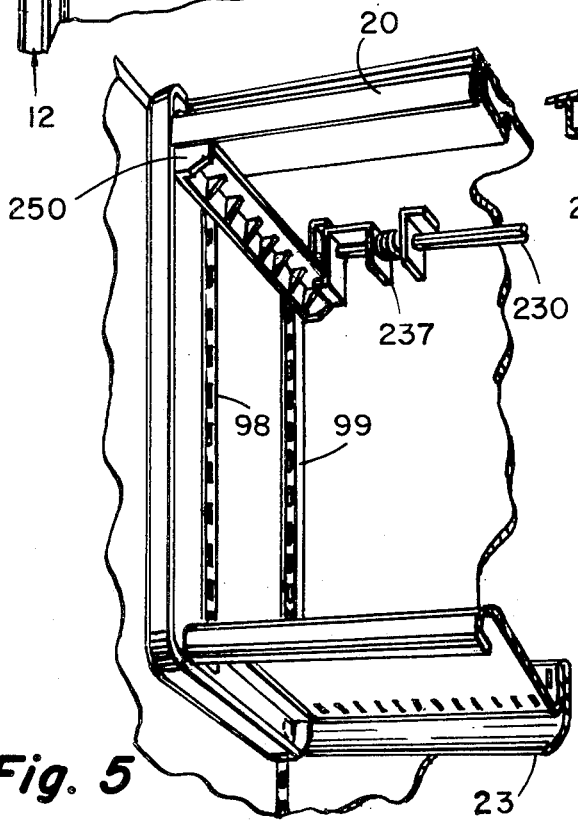
FIG. 5 is a fragmentary lower perspective view of the left side portion of the cabinet of FIG. 4.
Figure 6:
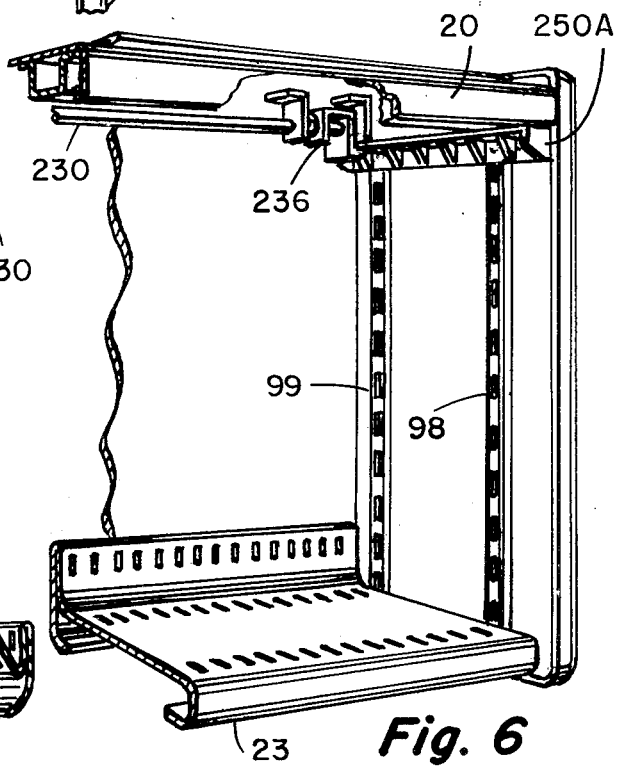
FIG. 6 is a fragmentary perspective view, taken at a higher perspective than FIG. 5, of the right side of the cabinet of FIG. 4 with a portion of the flipper door cut away to show the rack slide.

With the tracks in place within the cabinet as shown in FIGS. 5 and 6, the flipper door may be inserted by urging the clips 236, 237 on the rod 230 toward the center (compare FIGS. 57 and 58), until the clips clear their respective tracks. The pinions are then set to engage the racks 251 on the tracks, and in the fully inserted position, the distal flanges of the channels 226, 227 rest on the track, as seen in FIG. 57, to support the forward portion of the flipper door in the horizontal position. The rear portion is supported, of course, by the pinion and rod. When the clips 236 are released, the coil springs 240, 241 urge them outwardly and into engagement with their associated tracks, and the door is held in place by the lower flanges 236A, 237A as they are received beneath the tracks. It will be observed from FIG. 57 that the clip 236 prevents complete withdrawal of the flipper door because it would interfere with the larger brace 254 at the forward position. This is further indicated in FIG. 43 which shows the flipper door in a partially open position. The flipper door is shown fully open in FIG. 42.

Referring now to FIG. 43, it will be seen that the forward edge 208 of the cabinet top 24 does not extend completely to the front of the cabinet but terminates short of that position so that when the flipper door is fully extended horizontally, it may be rotated about the rod 230, and the rearwardly bent upper portion 220A of the sheet metal 220 will be flush with the top of the cabinet and appear to be an extension of it, as best illustrated in FIGS. 1 and 3.

Figure 63:
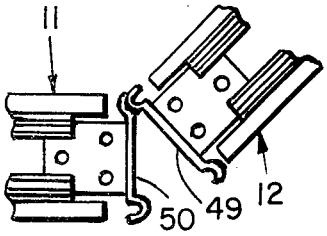
Figure 64:
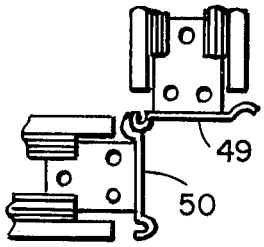
Figure 65:
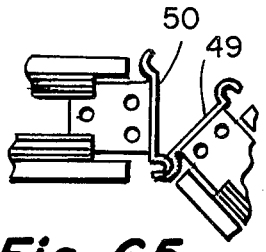

Turning now to FIGS. 62–65, there is illustrated the cooperation between end connector elements 49, 50 which prevent light leaks between adjacent panels 11, 12 for the various positions of the two panels. For example, in FIG. 62, the panels are in line or define an angle of 180°. In FIG. 63, the panels are arranged in an obtuse included angle. In FIG. 64 they are formed at a 90° angle, and in FIG. 65 they form an angle between 180° and 270°. In the straight position of FIG. 62, both edges of the elements 49, 50 form light seals, whereas in FIGS. 63 and 64 only the upper edges cooperate. In FIG. 65, the lower edges cooperate to form a light seal.

Figure 66:
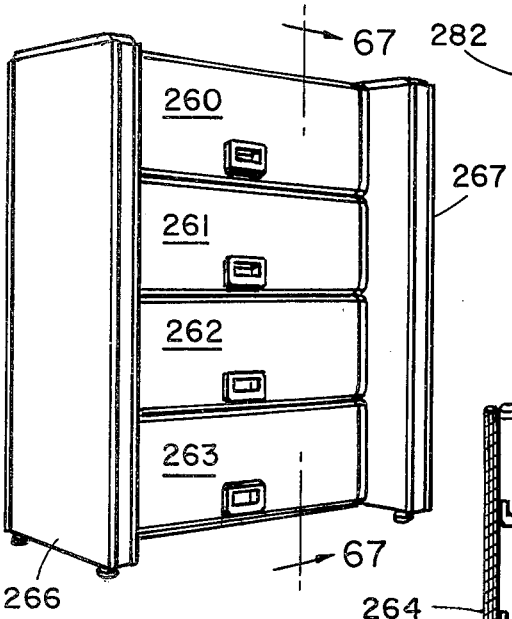
FIG. 66 is a perspective view of a series of cabinets arranged one above the other and supported by a panel wall.
Figure 67:
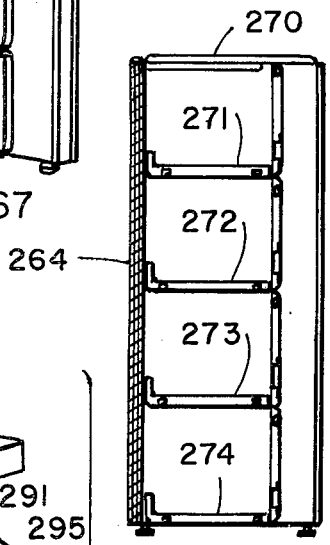
FIG. 67 is a vertical cross sectional view of the apparatus of FIG. 66 taken through the sight line 67—67 thereof.

Referring now to FIGS. 66 and 67, the system is shown in a set-up including four individual cabinets 260, 261, 262 and 263 in a vertical stack, all hung in the recessed hanging slots on a rear panel 264, and including first and second side panels 266, 267. As best seen in FIG. 67, this arrangement includes a cabinet top 270, and four cabinet bottom shelves designated respectively 271–274. The top 270 and bottom shelves 271 are mounted in their associated side panels as previously disclosed, and this arrangement thus permits vertical stacking of cabinets which eliminates a separate top panel for each of the cabinets except the uppermost one.

Figure 68:
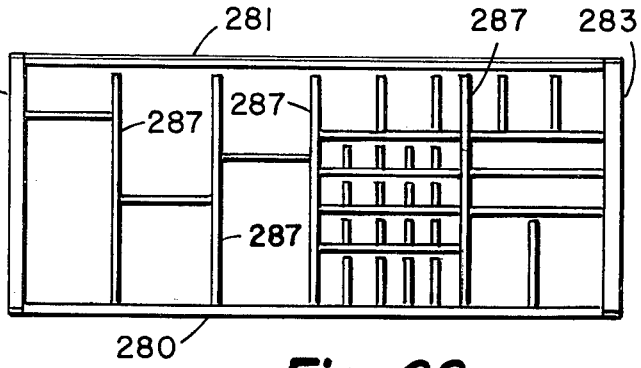
FIG. 68 is a frontal diagrammatic view of a single cabinet illustrating the flexibility in vertical and horizontal spacing that may be attained with the system of the present invention.

Turning now to FIG. 68, there is illustrated one arrangement of vertical support assemblies and partitions demonstrating the horizontal and vertical modularity which may be incorporated into the system. Thus, a bottom shelf 280 and cabinet top 281, together with first and second cabinet side panels 282, 283 are assembled as already disclosed. A plurality of vertical separator assemblies 287 are then mounted to the bottom shelf 280, and partial shelves are inserted as desired. Individual separator plates or envelope bins are then installed on the shelving as desired.

Figure 69:
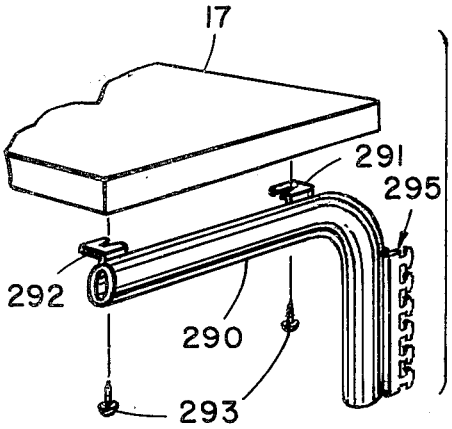
FIG. 69 is a fragmentary perspective view, with the parts in exploded relation, of the cantilever mounting for a work station, using the recessed hanging slots.

Referring now to FIG. 69, there is disclosed one manner of mounting the work surface 17 in a cantilever manner including a cantilever bracket 290 which includes first and second slotted brackets 291, 292 through which screws 293 are placed for securing to the underside of the work surface 17. To the rear of the bracket 290 there is welded a bracket 295 provided with a plurality of hooked tabs of the type already described for fitting into the recessed hanging slots. The other side of the work surface may be mounted similarly, and structures other than the particular mounting brackets shown may be used to secure the work surface, such as a slide and drop arrangement of slots and pins.

Referring now to FIGS. 70–73, another feature of the invention is that it is readily adapted for the incorporation of drawer slides and such slides may be used to mount work surfaces (as seen in FIG. 71), shelves (FIG. 72) or files (FIG. 73).

In FIG. 70, there is shown a three-piece drawer slide having an outer section 301, and intermediate section 302 and an inner section 303. This is a conventional drawer slide except that the outer section 301 is provided with a first tab 304 and a hooked tab 305 to fit into and be secured to the upright channels in a cabinet side panel or similar structure.

In FIG. 71, two drawer slides are shown and designated 300, and a work surface 307 is mounted to the innermost sections of the slides so that it may be pulled out as desired.

In FIG. 72, a bottom shelf 309 is secured to the inner sections of the drawer slides 300, and it includes laterally spaced forward slots 310 and a set of aligned rear slots 311 formed in an upright rear flange 312.

In FIG. 73, the drawer slides 300 are used for mounting a frame 320 including first and second frame members 321, 322 parallel to the drawer slides and spaced for mounting legal size pocket folders such as the one designated 323. The frame 320 includes first and second transverse frame members 324, 325, which are spaced for mounting a letter size pocket folder 328.

It will thus be appreciated that the invention has wide adaptability in providing vertical and horizontal modularity and cabinet space, and it is also adapted for pull-out work surfaces, shelves and file folders.

Having thus disclosed in detail preferred embodiments of the invention, persons skilled in the art will be able to modify certain of the structure which has been illustrated, and to substitute equivalent elements for those disclosed while continuing to practice the principle of the invention; and it is, therefore, intended that all such modifications and substitutions be covered as they are embraced within the spirit and scope of the appended claims.

We claim:

1. In a panel wall system, an improved panel comprising a peripheral frame including first and second side upright tubular frame members and upper and lower rigid frame members secured respectively to the upper and lower portions of said upright frame members forming a rigid peripheral frame, each of said side frame members defining a set of vertically spaced hanging slots on opposite sides thereof, and at least a pair of vertically spaced insert slots spaced inwardly of said hanging slots; first and second inserts, one on either side of said frame, each insert including a sheet of facing material and having inwardly turned edges providing a peripheral flange of substantially the same size and shape as said frame; upper and lower reinforcement means for said inserts for strengthening the same, coupling means on said reinforcement means for coupling to said insert slots on said frame; whereby said inserts are removably secured by said tabs alone to opposite sides of said frame respectively and when they are so secured, said hanging slots are recessed relative to said inserts and spaced outwardly on either side thereof so as to be accessible for removably attaching other system components to said frame, said inserts being independently removable from said frame by a lifting motion.

2. The apparatus of claim 1 wherein each of said upright tubular supports is a rectangular tube having said hanging slots on either side thereof in registration, and each tube includes an inwardly projecting flange formed from the material of said tube and interposed between opposing sets of said hanging slots to provide a sight barrier therebetween.

3. The apparatus of claim 1 wherein said reinforcement means on said panel inserts each comprise a horizontally elongated channel member secured to the inner side thereof, and wherein said connecting means comprise tabs on said reinforcement members projecting toward the interior of said panel.

4. The apparatus of claim 3 wherein each of said coupling means comprising tabs tapered toward a distal end providing a lead-in to said insert slots, the distal end being curved outwardly from the body of the tab for guiding the tabs into said slots.

* * * * *